US009746802B2

(12) United States Patent
Yokoyama

(10) Patent No.: US 9,746,802 B2
(45) **Date of Patent: *Aug. 29, 2017**

(54) IMAGE FORMING APPARATUS AND IMAGE FORMING METHOD FOR FORMING A TRANSPARENT TONER IMAGE AND A COLOR IMAGE

(71) Applicants: KABUSHIKI KAISHA TOSHIBA, Tokyo (JP); TOSHIBA TEC KABUSHIKI KAISHA, Tokyo (JP)

(72) Inventor: Yuichi Yokoyama, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/228,489

(22) Filed: Aug. 4, 2016

(65) Prior Publication Data

US 2016/0342114 A1 Nov. 24, 2016

Related U.S. Application Data

(63) Continuation of application No. 14/293,971, filed on Jun. 2, 2014, now Pat. No. 9,417,546.

(51) Int. Cl.

| | |
|---|---|
| ***G03G 15/30*** | (2006.01) |
| ***G03G 15/16*** | (2006.01) |
| ***G03G 15/01*** | (2006.01) |
| ***G03G 15/00*** | (2006.01) |

(52) U.S. Cl.

CPC ..... *G03G 15/1605* (2013.01); *G03G 15/0131* (2013.01); *G03G 15/6585* (2013.01); *G03G 2215/0132* (2013.01)

(58) Field of Classification Search

None

See application file for complete search history.

(56) References Cited

U.S. PATENT DOCUMENTS

| | | | | |
|---|---|---|---|---|
| 9,417,546 | B2 * | 8/2016 | Yokoyama | G03G 15/0131 |
| 2003/0020676 | A1 | 1/2003 | Lin et al. | |
| 2010/0247129 | A1 | 9/2010 | Hyakutake et al. | |
| 2013/0064558 | A1 | 3/2013 | Futamata | |
| 2016/0259292 | A1 * | 9/2016 | Kawasaki | G03G 21/00 |
| 2017/0090365 | A1 * | 3/2017 | Shimazu | G03G 15/2053 |

FOREIGN PATENT DOCUMENTS

| | | |
|---|---|---|
| JP | 2013-095018 | 5/2013 |

* cited by examiner

*Primary Examiner* — David M Gray
*Assistant Examiner* — Geoffrey T Evans
(74) *Attorney, Agent, or Firm* — Patterson & Sheridan, LLP

(57) ABSTRACT

An image forming apparatus according to an embodiment includes a first image forming unit that forms a transparent toner image and a second image forming unit that forms a color toner image. The transparent toner image and the color toner image are transferred onto an intermediate transfer belt. A secondary transfer unit transfers the toner images from the intermediate transfer belt to a recording medium. A control unit controls the first image forming unit and the second image forming unit so that the transparent toner image is formed before the color toner image is formed when the recording medium is a specialty paper having an adhesive.

20 Claims, 3 Drawing Sheets

| TRANSPARENT TONER DEPOSITION AMOUNT ON BELT (mg/cm²) | 0.15 | 0.1 | 0.05 | 0.02 | 0.01 |
|---|---|---|---|---|---|
| ADHESIVE DEPOSITION LEVEL | ○ | ○ | △ | △ | × |

○: ADHESIVE DOES NOT BECOME ATTACHED TO BELT
△: ADHESIVE BEGINS TO BECOME ATTACHED TO BELT
×: ADHESIVE BECOMES ATTACHED TO BELT

| TRANSPARENT TONER DEPOSITION AMOUNT ON BELT (mg/cm$^2$) | 0.15 | 0.1 | 0.05 | 0.02 | 0.01 |
|---|---|---|---|---|---|
| ADHESIVE DEPOSITION LEVEL | ○ | ○ | △ | △ | × |

○: ADHESIVE DOES NOT BECOME ATTACHED TO BELT
△: ADHESIVE BEGINS TO BECOME ATTACHED TO BELT
×: ADHESIVE BECOMES ATTACHED TO BELT

IMAGE FORMING APPARATUS AND IMAGE FORMING METHOD FOR FORMING A TRANSPARENT TONER IMAGE AND A COLOR IMAGE

CROSS-REFERENCE TO RELATED APPLICATION

This application is a continuation of co-pending U.S. patent application Ser. No. 14/293,971, filed on Jun. 2, 2014, the entire contents of each of which are incorporated herein by reference.

FIELD

Embodiments described herein relate generally to an image forming apparatus and an image forming method that uses an intermediate transfer belt.

BACKGROUND

In recent years, in image forming apparatuses of the related art in which intermediate transfer belts are used, a broad range of type of recording medium has been used such as sheets or labels. Some recording media may include an adhesive, such as a label sheet or a double-layered slip.

However, when an adhesive portion extends from an end part or a cut in a recording medium that includes an adhesive, there is a problem in that the adhesive becomes attached to the intermediate transfer belt, toner becomes attached thereto, and it is difficult to sufficiently complete cleaning of the intermediate transfer belt, causing the occurrence of image soiling from the next print onwards.

DETAILED DESCRIPTION

An image forming apparatus according to an embodiment includes a first image forming unit that forms a transparent toner image and a second image forming unit that forms a color toner image. The transparent toner image and the color toner image are transferred onto an intermediate transfer belt. A secondary transfer unit transfers the toner images from the intermediate transfer belt to a recording medium. A control unit controls the first image forming unit and the second image forming unit so that the transparent toner image is formed before the color toner image is formed when the recording medium is a specialty paper having an adhesive.

Hereinafter, embodiments will be described in detail with reference to the drawings.

First Embodiment

Figure 1:
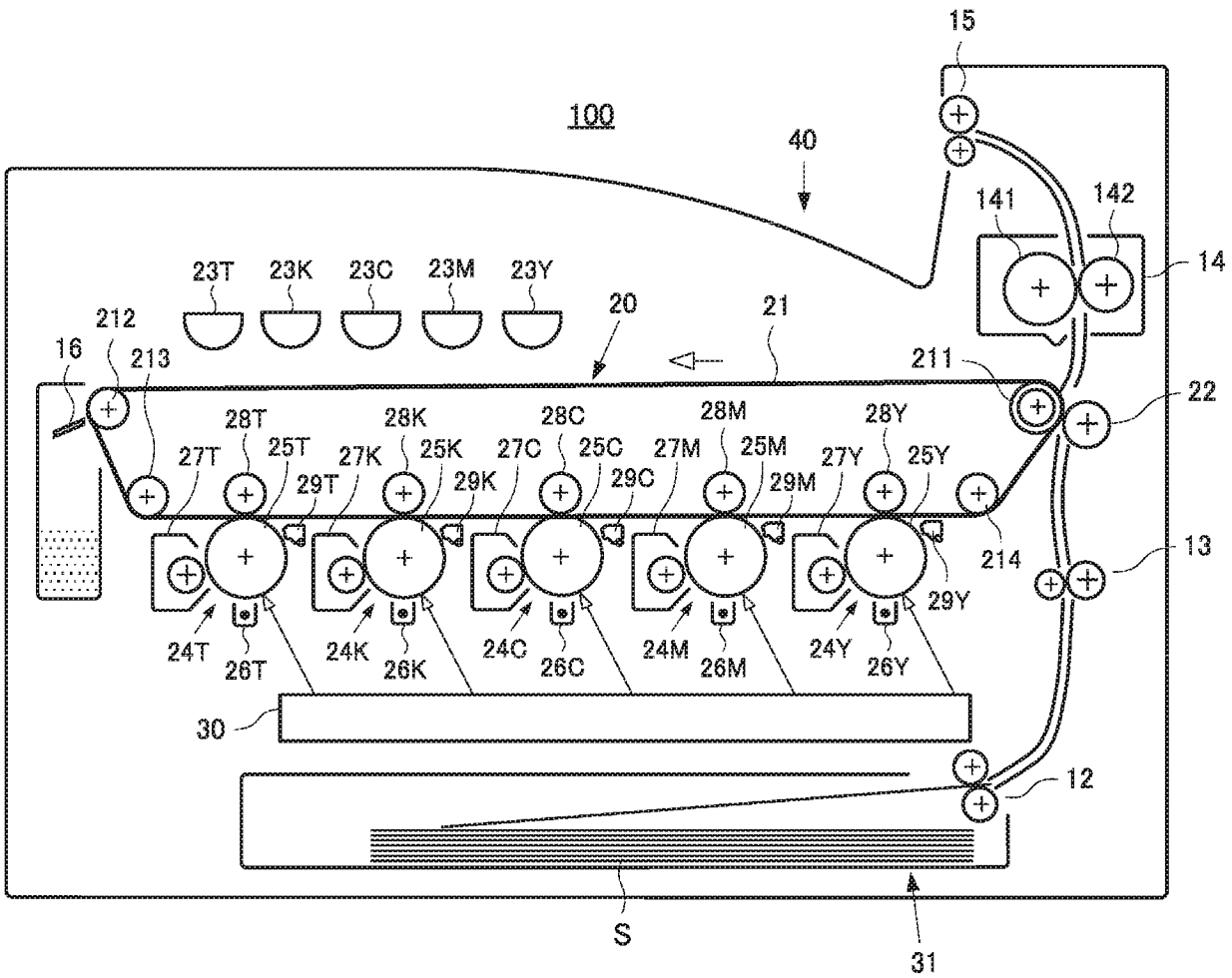
FIG. 1 is a schematic view illustrating a first embodiment of an image forming apparatus.

FIG. 1 is a schematic view illustrating a first embodiment of an image forming apparatus. An image forming method may be implemented with the illustrated image forming apparatus.

This embodiment uses a digital Multi Function Peripheral (MFP) 100 in which a color electrophotographic apparatus is used as an image forming apparatus. FIG. 1 illustrates a schematic view of an image forming apparatus, which is a 4-unit tandem color printer, as an example of the color electrophotographic apparatus of the MFP 100. The MFP 100 includes a printing unit 20, a paper feeding unit 31 and a paper discharge unit 40. In order to simplify the drawings, an automatic document transport unit, a scanner unit, and the like, are omitted from the drawings.

The printing unit 20 includes an endless intermediate transfer belt 21 which rotates along a direction that is shown by a white arrow in the drawing. The intermediate transfer belt 21 is cyclically transported by being extended between a drive roller 211 and driven rollers 212 to 214. The intermediate transfer belt 21 is made of, for example, a semiconductive polyimide, or other material that is suitable from the viewpoint of heat resistance and anti-abrasive properties.

The printing unit 20 is provided with a secondary transfer roller 22 (i.e., a secondary transfer unit) for transferring images on the intermediate transfer belt 21 to the recording medium, and four image forming stations 24K, 24C, 24M and 24Y for K (black) and the chromatic colors of C (cyan), M (magenta) and Y (yellow), respectively.

The printing unit 20 is provided with refill cartridges 23K, 23C, 23M and 23Y above the image forming stations 24K, 24C, 24M and 24Y. The refill cartridges 23K, 23C, 23M and 23Y respectively store black toner, cyan toner, magenta toner and yellow toner.

The image forming stations 24K, 24C, 24M, and 24Y are provided with photoreceptor drums 25K, 25C, 25M and 25Y (i.e., image carriers). The image forming stations 24K, 24C, 24M and 24Y are also provided with charging units 26K, 26C, 26M and 26Y, an image development roller, (i.e., image development member), and the like in the vicinity of each photoreceptor drum.

The image forming stations 24K, 24C, 24M, and 24Y are provided with image developers 27K, 27C, 27M and 27Y in which toner of each of the colors black, cyan, magenta and yellow is respectively stored. The image forming stations 24K, 24C, 24M and 24Y are provided with primary transfer rollers 28K, 28C, 28M and 28Y (i.e., primary transfer units). The photoreceptor drums 25K, 25C, 25M, and 25Y are disposed, along a rotational direction, at positions that respectively oppose the primary transfer rollers 28K, 28C, 28M and 28Y. Furthermore, positions that respectively oppose the photoreceptor drums 25K, 25C, 25M and 25Y are provided with photoreceptor cleaners 29K, 29C, 29M and 29Y.

The primary transfer rollers 28K, 28C, 28M and 28Y are arranged on an inner side of the intermediate transfer belt 21, and the intermediate transfer belt 21 is gripped between the primary transfer rollers 28K, 28C, 28M and 28Y and the photoreceptor drums 25K, 25C, 25M and 25Y.

Furthermore, the printing unit 20 includes an image forming station 24T on an upstream side of the image forming station 24K in a transport direction of the intermediate transfer belt 21. The image forming station 24T includes a photoreceptor drum 25T, a charging unit 26T, an image developer 27T, a primary transfer roller 28T, and a photoreceptor cleaner 29T in the same manner as the image forming station 24K. T (transparent) toner is stored in the image developer 27T.

The printing unit 20 is provided with a refill cartridge 23T above the image forming station 24T. The refill cartridge 23T stores transparent toner for refilling.

A laser exposure device 30 is arranged so that an exposure point is formed on the outer circumferential surface of the photoreceptor drums 25K, 25C, 25M, 25Y and 25T between the respective charging units 26K, 26C, 26M, 26Y and 26T and image developers 27K, 27C, 27M, 27Y and 27T. The laser exposure device 30 is disposed on the outer side of the intermediate transfer belt 21 so as to be in contact with the secondary transfer roller 22. The laser exposure device 30 includes a polygon mirror, an imaging lens system and a mirror. The laser exposure device 30 respectively scans laser beams that are output from a semiconductor laser element and modulated by image data in an axial direction of photoreceptor drums 25K, 25C, 25M, 25Y and 25T that rotate using the polygon mirror.

The paper feeding unit 31 accommodates sheets S of various sizes. Additionally, in FIG. 1, only a single paper feeding unit is illustrated. The paper discharge unit 40 accommodates discharged sheets S upon which image formation is performed.

In addition, between the paper feeding unit 31 and the paper discharge unit 40, there is a paper feeding roller 12 that extracts sheets S inside the paper feeding unit 31, a resist roller 13 and the like. Furthermore, there is a fixing unit 14 downstream in a sheet transport direction of the resist roller 13 in a position that is after the secondary transfer of the intermediate transfer belt 21. There is a discharge roller 15 and a paper discharge unit 40 downstream of the fixing unit 14.

The paper discharge unit 40 discharges sheets S on which toner images have been fixed by the fixing unit 14. A reverse transport pathway (not illustrated in the drawings) is disposed downstream of the fixing unit 14. When double-sided printing is performed, the sheets S are reversed in the reverse transport pathway and led in the direction of the secondary transfer roller 22 for performing double-sided printing.

The sheets S that are extracted from the paper feeding unit 31 by the paper feeding roller 12 are transported to the secondary transfer unit between the intermediate transfer belt 21 and the secondary transfer roller 22 through the resist roller 13. When the sheets S pass through the secondary transfer unit, a secondary transfer voltage is applied to the sheets S by the secondary transfer roller 22, and toner images on the intermediate transfer belt 21 are secondary transferred to the sheets S. Sheets S onto which toner images have been transferred are discharged to the paper discharge unit 40 after the toner images are fixed by the fixing unit 14.

The fixing unit 14 includes a heating roller 141 in which, for example, an IH heater is equipped as a heat source, and a pressurization roller 142. Toner images are fixed onto the sheets S by pressing the sheets S (onto which toner images have been transferred) between the heating roller 141 and the pressurization roller 142.

A belt cleaner 16 is disposed in the vicinity of the driven roller 212 of the intermediate transfer belt 21. Residual toner that has not been transferred to the sheets S in the secondary transfer process is cleaned with the belt cleaner 16.

Next, image formation in the above-mentioned configuration will be described. When an instruction for the initiation of an image formation action is received, the photoreceptor drum 25T receives drive power from a drive mechanism (not illustrated in the drawings) and starts to rotate. The charging unit 26T uniformly charges the photoreceptor drum 25T to −600 V, for example.

The image forming station 24T irradiates light that corresponds to an image to be printed and forms electrostatic latent images on the photoreceptor drum 25T that is uniformly charged by the charging unit 26T. Transparent toner is accommodated in the image developer 27T. The image developer 27T applies a bias value of for example, −380 V to an image development sleeve (not illustrated in the drawings) using an image development bias power supply (not illustrated in the drawings), and an image development electrical field is formed between the photoreceptor drum 25T. Transparent (T) toner that is negatively charged becomes attached to an image negative potential region of the electrostatic latent images of the photoreceptor drum 25T, and transparent toner images are formed on the surface of the photoreceptor drum 25T. The photoreceptor cleaner 29T removes toner that remains in the photoreceptor drum 25T after primary transfer.

The properties of the transparent toner is essentially the same as that of the normal toners (K, C, M and Y), except that the pigment for coloring has been removed from a color toner. The image forming station 24T may form images in the same manner as the image forming stations 24K, 24C, 24M and 24Y. However, since the transparent toner is transparent, even when the transparent toner is printed onto the sheets S, there is no influence on a visible printed pattern.

Black toner images, cyan toner images, magenta toner images and yellow toner images are respectively formed on the surfaces of the photoreceptor drums 25K, 25C, 25M and 25Y in the same manner. That is, the respective toner images of black, cyan, magenta and yellow are formed on the transparent (T) toner images. The photoreceptor cleaners 29K, 29C, 29M and 29Y remove toner that remains in the photoreceptor drums 25K, 25C, 25M and 25Y after the primary transfer.

The primary transfer roller 28T is provided in a position in which the photoreceptor drum 25T abuts against the intermediate transfer belt 21 with the intermediate transfer belt 21 interposed between the photoreceptor drum 25T and the primary transfer roller 28T. A desired voltage of for example, a bias voltage of +1,000 V is applied to the primary transfer roller 28T. A transfer electric field is formed between the primary transfer roller 28T and the photoreceptor drum 25T as a result of the bias voltage. The T toner images that are on the photoreceptor drum 25T are transferred to the intermediate transfer belt 21 depending on the transfer electric field.

The T toner images on the intermediate transfer belt 21 are transported to a position that opposes the photoreceptor drum 25K, and K toner images on the photoreceptor drum 25K are transferred overlapping the T toner images on the intermediate transfer belt 21.

Subsequently, in the same manner, the C toner images on the photoreceptor drum 25C, the M toner images on the photoreceptor drum 25M and the Y toner images on the photoreceptor drum 25Y are transferred to the intermediate transfer belt 21 in sequence.

In this manner, each of the toner images of K, C, M and Y are transferred to the intermediate transfer belt 21 overlapping the T toner images, and color toner transfer images are formed.

Meanwhile, the paper feeding roller 12 extracts sheets S from the paper feeding unit 31, and the resist roller 13 transports the sheets S to the secondary transfer unit between the intermediate transfer belt 21 and the secondary transfer roller 22. In the secondary transfer unit, a desired bias voltage is applied to the secondary transfer roller 22. A transfer electric field is formed between the secondary transfer roller 22 and the drive roller 211 with the intermediate transfer belt 21 interposed therebetween. Color toner transfer images on the intermediate transfer belt 21 are transferred to a blank piece of paper in a batch as a result of the transfer electric field. Each color of toner image that is transferred in a batch is fixed to the blank piece of paper by the fixing unit 14, and color images are ultimately formed on the blank piece of paper. Sheets S on which fixing has been finished are discharged onto the paper discharge unit 40. After secondary transfer between the intermediate transfer belt 21 and the secondary transfer roller 22, residual toner that remains on the surface of the intermediate transfer belt 21 is removed by a belt cleaner 16.

The image forming station 24T is disposed further upstream in the transport direction of the intermediate transfer belt 21 than the image forming station 24K in consideration of secondary transfer properties. When toners that overlap on the belt are secondary transferred, the transfer efficiency of toner on the belt side is low. Accordingly, the station of the transparent toner that does not contribute to an output image is disposed furthest upstream.

When printing is performed on a recording medium without an adhesive, image formation is not performed at the image forming station 24T, and a configuration in which transparent toner is not printed onto the intermediate transfer belt 21 is used. Further, when a recording medium to which adhesive is attached is used, image formation is performed at the image forming station 24T and transparent toner is printed onto the intermediate transfer belt 21.

Figures 2, 3:
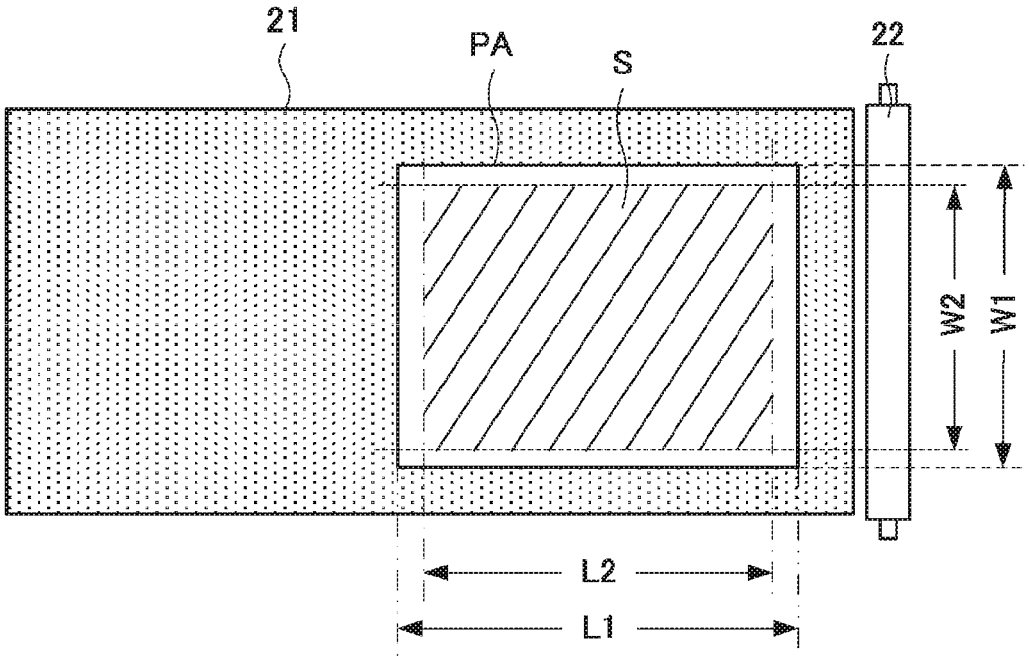
FIG. 2 is a view illustrating positions of a transfer belt, a sheet, and a transparent toner formation region, according to the first embodiment.
FIG. 3 is a chart of example adhesive attachment relative to transparent toner deposition amounts.

FIG. 2 is an explanatory view illustrating an image formation range of the image forming station 24T and image formation ranges of the image forming stations 24K, 24C, 24M and 24Y.

An image formation range PA of the image forming station 24T is a range that is larger than the sheet S. That is, the length L1 of the image formation range PA has the relationship L1>L2 with the length L2 of the sheet S. The width W1 of the image formation range PA has the relationship W1>W2 with the width W2 of the sheet S.

In this manner, the size of the image formation range PA is larger than the size of the sheet S. As a result of this, when the sheet S comes into contact with the intermediate transfer belt 21 in the secondary transfer unit, it is possible to prevent adhesive that runs out from the sheet S from becoming attached to the intermediate transfer belt 21 due to the presence of the transparent toner that is formed first.

FIG. 3 illustrates a relationship between a transparent toner deposition amount on the intermediate transfer belt 21 and an adhesive attachment. If the transparent toner deposition amount is 0.1 mg/cm$^2$ or more, the adhesive does not become attached. However, if the transparent toner deposition amount is 0.02 mg/cm$^2$ or more (but less than 0.1 mg/cm$^2$, the adhesive begins to become attached, but not completely attached, to the intermediate transfer belt 21. Further, if the transparent toner deposition amount is 0.01 mg/cm$^2$ (or less), the adhesive becomes attached. Therefore, printing may be performed with at least 0.02 mg/cm$^2$ as the transparent toner deposition amount.

In this manner, the image forming station that forms transparent toner is mounted on the intermediate transfer belt 21 on an upstream side of the image forming station for normal color toner. When a specialty paper to which adhesive is attached is used, a desired amount of transparent toner on the intermediate transfer belt 21 is formed over an area that is wider than the sheet used. As a result of this, in the secondary transfer unit in which the sheet is in contact with the intermediate transfer belt 21, it is possible to prevent the adhesive from becoming attached to the intermediate transfer belt 21 due to the presence of the transparent toner.

In this embodiment, even if a recording medium that uses an adhesive is used, it is possible to retain favorable image formation without adhesive becoming attached to the intermediate transfer belt.

Second Embodiment

Figure 4:
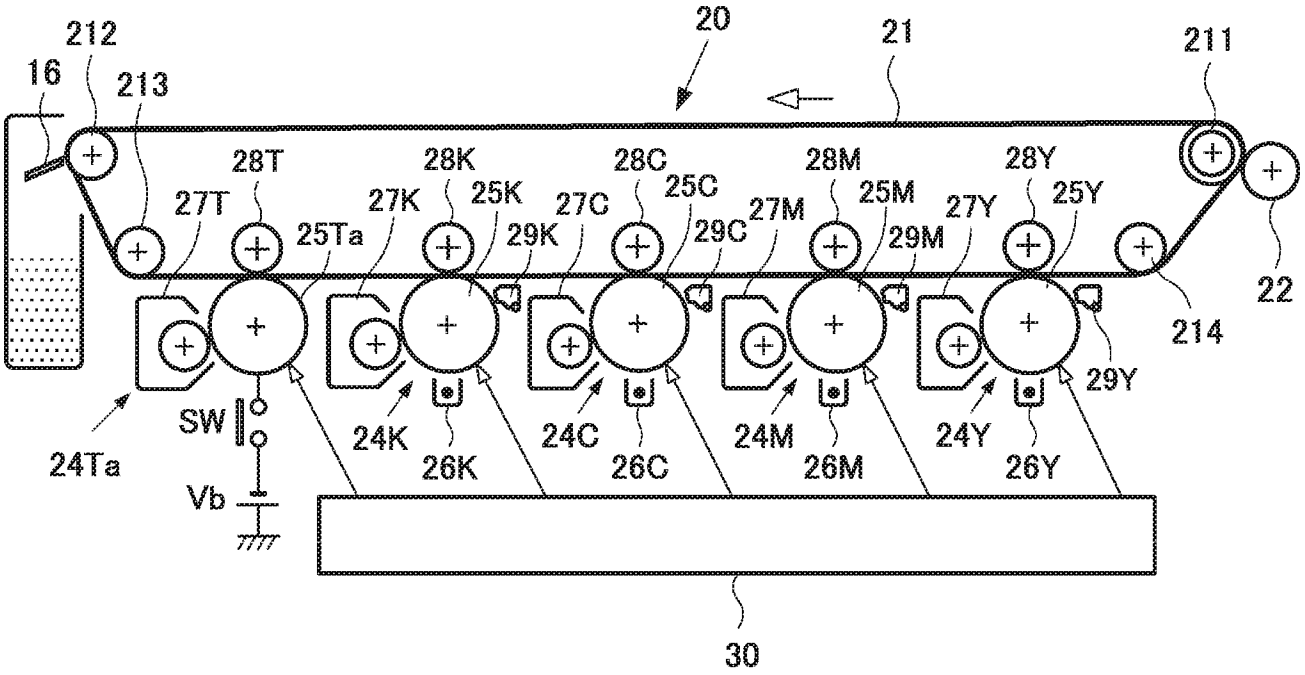
FIG. 4 is a schematic view illustrating an image forming section of an image forming apparatus, according to a second embodiment.

FIG. 4 is a schematic view illustrating an image forming section of an image forming apparatus, according to a second embodiment.

In this embodiment, it is possible to form the transparent toner over the entire intermediate transfer belt 21 with a simple configuration. That is, an image forming station 24Ta that uses an aluminum element tube photoreceptor drum 25Ta is used in place of the photoreceptor drum 25T of the image forming station 24T that is used in the first embodiment. Further, it is possible to apply a bias voltage Vb to the photoreceptor drum 25Ta with the control of a switch SW.

When the bias voltage Vb is applied to the photoreceptor drum 25Ta, the entire photoreceptor drum 25Ta is electrified with static. As a result of this, it is possible to form the transparent toner uniformly. By controlling the value of the bias voltage Vb, it is possible to modify the deposition amount of the transparent toner.

In this embodiment, by simply applying a bias to a photoreceptor drum that may be electrified with static by a bias voltage, it is possible to fulfill the roll of a charging unit. Therefore, the installation of a separate charging unit is not necessary. In addition, a configuration in which the photoreceptor drum is electrified with static by on-and-off control of the bias voltage is used. When the bias voltage is off, the transparent toner that is formed on the photoreceptor drum is removed. Therefore, it is possible to omit a transparent toner cleaning mechanism of the photoreceptor drum.

The exemplary embodiment is not limited to the above-mentioned embodiments. For example, when positions at which an adhesive of specialty paper comes into contact with a secondary transfer belt are known, transparent toner may be printed onto such known portions only. In addition, when adhesive only runs out at an end part of the sheet, a printing region of transparent toner that corresponds thereto is set and a recording medium of that size is used. As a result of this, it is possible to suppress the consumption of transparent toner.

In addition, as a toner of the image forming station 24T, a toner that is color erased at high fixing temperature may be used. In a normal color copy of such a case, the image forming stations 24K, 24C, 24M and 24Y are used. When printing color erasable toner only, the image forming station 24T is used and fixed at a low temperature. When preventing the attachment of adhesive, the image forming stations 24K, 24C, 24M and 24Y and the image forming station 24T are used, the fixing temperature is set to a high temperature and the toner of the image forming station 24T is color erased.

Furthermore, the image forming apparatus is not limited to a tandem method, and the number of image development apparatuses is not limited. The image forming apparatus may be an apparatus that directly transfers toner images to a recording medium from a photoreceptor.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a first image forming unit configured to form a transparent toner image;

a second image forming unit configured to form a color toner image;

an intermediate transfer belt onto which the transparent toner image and the color toner image are transferred;

a secondary transfer unit that transfers the toner images from the intermediate transfer belt to a recording medium; and a control unit configured to control the first image forming unit and the second image forming unit so that when the recording medium is a specialty paper having an adhesive:

the transparent toner image is formed before the color toner image is formed, and at least a portion of the transparent toner image is transferred onto the intermediate transfer belt outside of an area of the intermediate transfer belt at which the color toner image is transferred.

2. The image forming apparatus according to claim 1, wherein the portion of the transparent toner image is outside of an area of the specialty paper.

3. The image forming apparatus according to claim 1, wherein the transparent toner image is transferred to an upstream position of the intermediate transfer belt relative to a position on the intermediate transfer belt to which the color toner image is transferred, in a rotation direction of the intermediate transfer belt.

4. The image forming apparatus according to claim 1, wherein the color toner image formed by the second image forming unit is a black toner color image and at least one other color toner image.

5. The image forming apparatus according to claim 1, wherein a total area of the transparent toner image on the intermediate transfer belt is larger than a total area of the recording medium.

6. The image forming apparatus according to claim 1, wherein the control unit controls the first image forming unit to not form a transparent toner image when the recording medium is not a specialty paper having an adhesive.

7. The image forming apparatus according to claim 1, wherein an amount of transparent toner in the transparent toner image formed on the intermediate transfer belt is at least 0.02 $mg/cm^2$.

8. The image forming apparatus according to claim 1, wherein the first image forming unit is an aluminum tube, and the transparent toner image is formed by applying a bias voltage to the aluminum element tube.

9. The image forming apparatus according to claim 8, wherein an amount of toner forming the transparent toner image is controlled by a value of the bias voltage.

10. The image forming apparatus according to claim 1, wherein the transparent toner image is formed with a decolorable toner that is color erased by a heat treatment.

11. An image forming method comprising the steps of:

forming a transparent toner image;

forming a color toner image;

transferring the transparent toner image to an intermediate transfer belt;

transferring the color toner image to the intermediate transfer belt after transferring the transparent toner image; and transferring the color toner image and at least a portion of the transparent toner image to a specialty paper having an adhesive, wherein:

the transparent toner image is formed before the color toner image is formed, and at least a portion of the transparent toner image is transferred onto the intermediate transfer belt outside of an area of the intermediate transfer belt at which the color toner image is transferred.

12. The image forming method according to claim 11, wherein the portion of the transparent toner image is outside of an area of the specialty paper.

13. The image forming method according to claim 11, wherein the transparent toner image is transferred to an upstream position of the intermediate transfer belt relative to a position on the intermediate transfer belt to which the color toner image is transferred, in a rotation direction of the intermediate transfer belt.

14. The image forming method according to claim 11, wherein the color toner image is a black toner color image and at least one other color toner image.

15. The image forming method according to claim 11, wherein a total area of the transparent toner image on the intermediate transfer belt is larger than a total area of the recording medium.

16. The image forming method according to claim 11, wherein an amount of transparent toner in the transparent toner image formed on the intermediate transfer belt is at least 0.02 $mg/cm^2$.

17. The image forming method according to claim 11, wherein the transparent toner image is formed by applying a bias voltage to an aluminum element tube.

18. An image forming method comprising the steps of:

determining that a recording medium on which an image is to be formed is a specialty paper having an adhesive;

controlling an image forming unit so that the image forming unit forms a transparent toner image on an intermediate transfer belt and a color toner image on the intermediate transfer belt, the transparent toner image being formed before the color toner image is formed and wherein a portion of the transparent toner image is outside of an area of the intermediate transfer belt at which the color toner image is transferred;

conveying the specialty paper through a secondary transfer area between the intermediate transfer belt and a secondary transfer roller;

as the specialty paper is conveyed through the secondary transfer area, transferring the color toner image and the transparent toner image, not including the portion of the transparent toner image outside of the area of the intermediate transfer belt at which the color toner image is transferred, to the specialty paper; and fixing the color toner image on the specialty paper.

19. The image forming method according to claim 18, wherein the portion of the transparent toner image is outside of an area of the specialty paper.

20. The image forming method according to claim 18, wherein the transparent toner image is formed on the intermediate transfer belt beneath the color toner image.

* * * * *